US005898969A

United States Patent [19]

Middleton

[11] Patent Number: 5,898,969

[45] Date of Patent: May 4, 1999

[54] GUTTER CLEANER

[76] Inventor: Shirley Wayne Middleton, Box 2902 Hwy 3, Charlestown, Ind. 47111

[21] Appl. No.: 08/755,017

[22] Filed: Nov. 22, 1996

[51] Int. Cl.[6] ..... E04D 13/076

[52] U.S. Cl. ..... 15/236.04; 294/19.1

[58] Field of Search ..... 15/236.04; 294/19.1, 294/55

[56] References Cited

U.S. PATENT DOCUMENTS

| | | | |
|---|---|---|---|
| 3,626,542 | 12/1971 | Despain et al. | 15/236.04 |
| 3,858,267 | 1/1975 | Swannie | 15/236.04 |
| 4,298,224 | 11/1981 | Hansen et al. | 294/19.1 X |
| 4,447,927 | 5/1984 | Malless, Jr. | 15/236.04 |
| 4,502,806 | 3/1985 | Albertson | 294/19.1 X |
| 5,435,612 | 7/1995 | Kreiser | 294/19.1 |

FOREIGN PATENT DOCUMENTS

| | | | |
|---|---|---|---|
| 1559925 | 1/1980 | United Kingdom | 294/19.1 |

*Primary Examiner*—Mark Spisich

[57] ABSTRACT

The Gutter Cleaner is a plastic and steel combination, in which the handle is a hard plastic and the U shaped rod is made of steel. The dipper is made of a hard plastic. The plastic is molded around the steel rod. The handle has threaded female grooves inside the handle for the extension to be screwed into. The dipper has three slotted holes for the release of the water when removing out the leaves or debris.

1 Claim, 1 Drawing Sheet

GUTTER CLEANER

BACKGROUND OF THE INVENTION

The present invention relates to a Gutter Cleaner for removing of leaves and debris from gutters without using a ladder. Gutter Cleaner is a plastic and steel combination, in which the handle is a hard plastic and the U shaped rod is made of steel. The dipper is made of a hard plastic, in which the plastic is molded around the steel rod. The handle has threaded female grooves inside the handle for the extension to be screwed into. The dipper has three slotted holes for the release of the water dipping out the leaves from the gutter. This Gutter Cleaner is used for the cleaning of one story and two story homes by standing from the ground, by which inserting a extendible handle into the Gutter Cleaner.

SUMMARY OF THE INVENTION

The present inventin relates to a Gutter Cleaner which has easy storage, convience, and accessability in the removing of leaves and debris from gutter whithout using a ladder. The advantages of Gutter Cleaner is the heavy lifting of a ladder. The moving of the ladder. The climbing up and down from the ladder. The strain being placed upon the back. The falling or sliding off a ladder. This Gutter Cleaner will cut the expense of all existing problems which exist in our cleaning of gutters.

BRIEF DESCRIPTION OF THE DRAWINGS

The present invention wil be more fully understood by reference to the following detailed description thereof when read in conjunction with the attached drawings, and wherein.

DETAILED DESCRIPTION OF THE INVENTION

Figure 1:
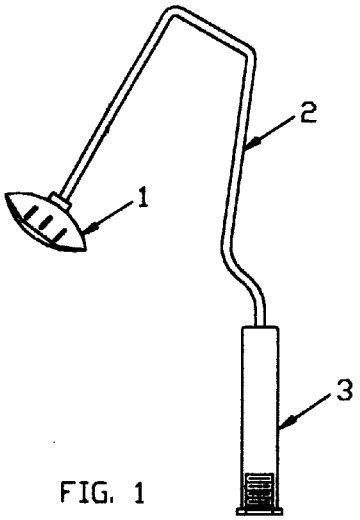
FIG. 1 is a front view with a scale one fourth inch equal two one inch.
Figure 2:
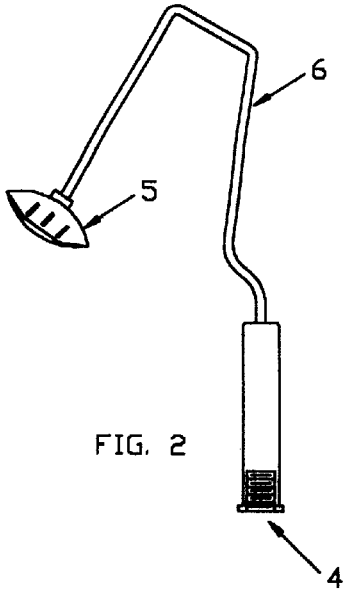
FIG. 2 is a back view with a color code of black.
Figure 3:
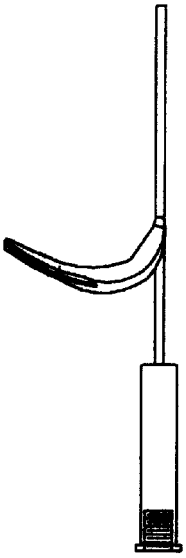
FIG. 3 is a left view of the Gutter Cleaner.
Figure 4:
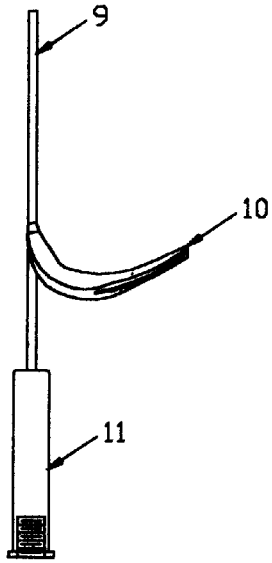
FIG. 4 is a right view with a Metal marking and plastic.
Figure 5:
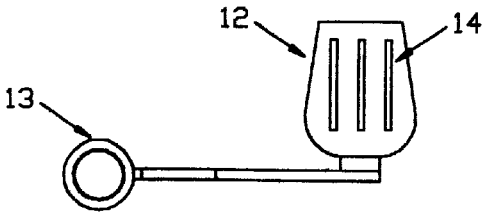
FIG. 5 is a viewing inside of the handle and bottom of the dipper of the spoon.
Figure 6:
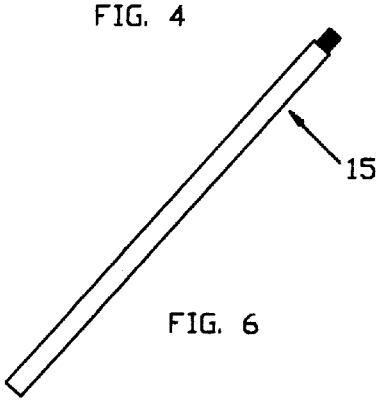
FIG. 6 is a type of extendible pole that will screw into the handle.

Referring now to the drawings, FIG. 1 there is shown a front view of the embodiment consisting of a plastic and steel combination, in which the handle 3 is a hard plastic and 2 is a U shaped rod. The dipper 1 is made of a hard plastic in which the plastic is molded around the steel rod 2. The handle 3 of the Gutter Cleaner has a female opening 13 for a screw 16 on the pole 15. The dipper 1 has three slotted holes 14 for the release of water when dipping out the leaves. This is a Gutter Cleaner for the easy removal of leaves and debris from gutters. FIG. 2 there is shown a back view of the Gutter Cleaner. 13 a female opening for a screw in attachment. 1 spoon dipper and 2 metal U shaped rod. FIG. 3 has a left view of the gutter cleaner. FIG. 4 is right view with metal markings on steel rod and plastic code markings on dipper and handle. FIG. 5 is a viewing inside of the bottom 12 of the dipper with the slotted holes 14. Also, the inside 13 of the plastic handle. FIG. 6 is a type of extendible pole 15 that will screw into the the handle 3 of the Gutter Cleaner.

I claim:

1. An implement for removing leaves and debris from gutters while standing on the ground, comprising:

(a) an elongated extension pole having external threads on an end thereof;

(b) an elongated plastic handle having opposite first and second ends, the first end having internal threads for attachment to and engagement with the threads on the extension pole whereby the plastic handle and extension pole are substantially aligned when connected;

(c) a steel rod having first, second and third elongated portions, a first end of said first elongated portion being molded within the second end of the elongated plastic handle, said first elongated portion being aligned with and substantially parallel to the longitudinal axis of the elongated plastic handle, said first elongated portion also having a second end, said second elongated portion also having a second end, said second elongated portion extending from the second end of the first elongated portion and defining an obtuse angle therebetween, said second elongated portion having and end opposite its point of attachment to the first elongated portion, said third elongated portion extending from the end of the second elongated portion, a substantial portion of the third elongated portion being substantially perpendicular to the second elongated portion, said elongated plastic handle, said first elongated portion, said second elongated portion and the substantial portion of the third elongated portion being substantially coplanar, said third elongated portion having an end portion extending from said substantial portion which is curved in a direction substantially perpendicular to said plane, said curved end portion of the third elongated portion having an end;

(d) a plastic dipper element attached to and molded around the end of said curved end portion of the third elongated portion, said plastic dipper element also extending in a direction substantially perpendicular to said plane, said plastic dipper element also having a plurality of closed ended slots therein for permitting the release of any water contained in the leaves and debris; and (e) wherein a user may clean the gutter while standing on the ground by gripping said extension pole and by removing the leaves and debris with said plastic dipper element.

* * * * *